US008070426B2

(12) United States Patent
Brunner et al.

(10) Patent No.: US 8,070,426 B2
(45) Date of Patent: Dec. 6, 2011

(54) SYSTEM, METHOD AND APPARATUS FOR OPEN IMPELLER AND DIFFUSER ASSEMBLY FOR MULTI-STAGE SUBMERSIBLE PUMP

(75) Inventors: Christopher Marvin Brunner, Owasso, OK (US); Jason B. Ives, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 781 days.

(21) Appl. No.: 12/122,819

(22) Filed: May 19, 2008

(65) Prior Publication Data

US 2009/0285678 A1 Nov. 19, 2009

(51) Int. Cl.
*F01D 11/14* (2006.01)

(52) U.S. Cl. ..... 415/174.3; 415/199.2; 415/901

(58) Field of Classification Search ..... 415/199.1, 415/199.2, 901, 903, 198.1, 104, 107, 174.3; 417/423.3

See application file for complete search history.

(56) References Cited

U.S. PATENT DOCUMENTS

| | | | | |
|---|---|---|---|---|
| 3,771,927 | A * | 11/1973 | Schiller | 415/173.3 |
| 3,841,791 | A | 10/1974 | Doolin | |
| 4,278,399 | A | 7/1981 | Erickson | |
| 5,133,639 | A | 7/1992 | Gay et al. | |
| 5,277,541 | A | 1/1994 | Palmer | |
| 5,385,442 | A | 1/1995 | Lehe et al. | |
| 5,427,498 | A | 6/1995 | Lehe et al. | |
| 6,676,369 | B2 | 1/2004 | Brauer et al. | |
| 6,726,449 | B2 | 4/2004 | James et al. | |
| 6,899,517 | B2 | 5/2005 | Gay et al. | |
| 6,971,848 | B2 | 12/2005 | Watson | |
| 7,118,327 | B2 | 10/2006 | Doering et al. | |

* cited by examiner

*Primary Examiner* — Richard Edgar
(74) *Attorney, Agent, or Firm* — Bracewell & Giuliani LLP

(57) ABSTRACT

A multi-stage submersible pump uses impellers having only one shroud to provide stages with shorter stack lengths to allow more stages per housing and more head pressure per housing. The impellers are biased with wave springs to keep the rotating impeller vanes close to the mating diffusers. The entire stack of impellers is assembled in contact with each other using the wave springs and are always under axial load. The wave springs also take up any tolerance variations in the stack to keep the impellers in proper running position. To keep the impellers in their proper locations, thrust washers formed from hard materials are used between adjacent impellers to avoid erosion thereof.

18 Claims, 4 Drawing Sheets

SYSTEM, METHOD AND APPARATUS FOR OPEN IMPELLER AND DIFFUSER ASSEMBLY FOR MULTI-STAGE SUBMERSIBLE PUMP

BACKGROUND OF THE INVENTION

1. Technical Field

The present invention relates in general to multi-stage pumps and, in particular, to a system, method and apparatus for an open shroud impeller and diffuser assembly for a multi-stage submersible pump.

2. Description of the Related Art

When an oil well is initially completed, the downhole pressure may be sufficient to force the well fluid up the well tubing string to the surface. The downhole pressure in some wells decreases, and some form of artificial lift is required to get the well fluid to the surface. One form of artificial lift is suspending an electric submersible pump (ESP) downhole, normally on the tubing string. The ESP provides the extra lift necessary for the well fluid to reach the surface. One type of ESP is a centrifugal pump. Centrifugal pumps have a series of impellers inside of a tubular housing, which are rotated by a drive shaft in order to propel fluids from the radial center of the pump towards the tubular housing enclosing the impellers.

The impellers have an inlet or an eye towards the radial center portion around the drive shaft. Spinning the impeller creates centrifugal forces on the fluid in the impeller. The centrifugal forces increase the velocity of the fluid in the impeller as the fluid is propelled towards the tubular housing. The height that the fluid would be able to travel in a passageway extending vertically from the exit of the impeller is the "head" generated from the impeller. A large amount of head is necessary in order to pump the well fluid to the surface. Either increasing the impeller diameter or increasing the number of impellers can increase the amount of head generated by a pump. The diameter of the impellers is limited by the diameter of the well assembly. Therefore, increasing the number of impellers is the common solution for downhole pumps in order to generate enough head to pump the well fluid to the surface.

The fluid enters a stationary diffuser after exiting the impeller. The fluid loses velocity in the diffuser because it is stationary. Decreasing the velocity of the fluid in the diffuser causes the pressure of the fluid to increase. The diffuser also redirects the fluid to the eye or inlet of the next impeller. Each impeller mounts directly to the drive shaft, but the diffusers slide over the drive shaft and land on the diffuser of the previous stage. Each impeller and diffuser is a "stage" in a pump. The pressure increase from one stage is additive to the amount of head created in the next stage. After enough stages, the cumulative pressure increase on the well fluid is large enough that head created in the last impeller pumps the well fluid to the surface. Thus, improved solutions for increasing the number of stages in a given length of well would be desirable.

SUMMARY OF THE INVENTION

Embodiments of a system, method, and apparatus for open shrouded impeller and diffuser assemblies for multi-stage submersible pumps are disclosed. The invention is particularly well suited for downhole pumps in an electric submersible pump (ESP) assembly. The open shroud impellers may be produced from a powdered metallurgy method without the need of fusing two or more parts together. The invention provides stages with shorter stack lengths to allow more stages per housing, which results in more head pressure per housing.

The assembly of a conventional multi-stage pump uses shrouded impellers that are allowed to "float" between the diffusers. In contrast, the invention uses impellers with biasing devices (e.g., wave springs) between them to keep the rotating impeller vanes close to the mating diffusers. The entire stack of impellers is assembled in contact with each other using the wave springs and are always under axial load. The wave springs also take up any tolerance variations in the stack to keep the impellers in proper running position.

To keep the impellers in their proper locations, thrust washers formed from hard materials (e.g., tungsten carbide, ceramic, etc.) may be used in some embodiments between adjacent impellers to avoid erosion thereof. The hard material also has a smooth surface finish to avoid increases in power consumption. Other advantages include equal or superior stage efficiency compared to conventional designs. Moreover, the overall performance of the new pump is greater than that of shrouded designs.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
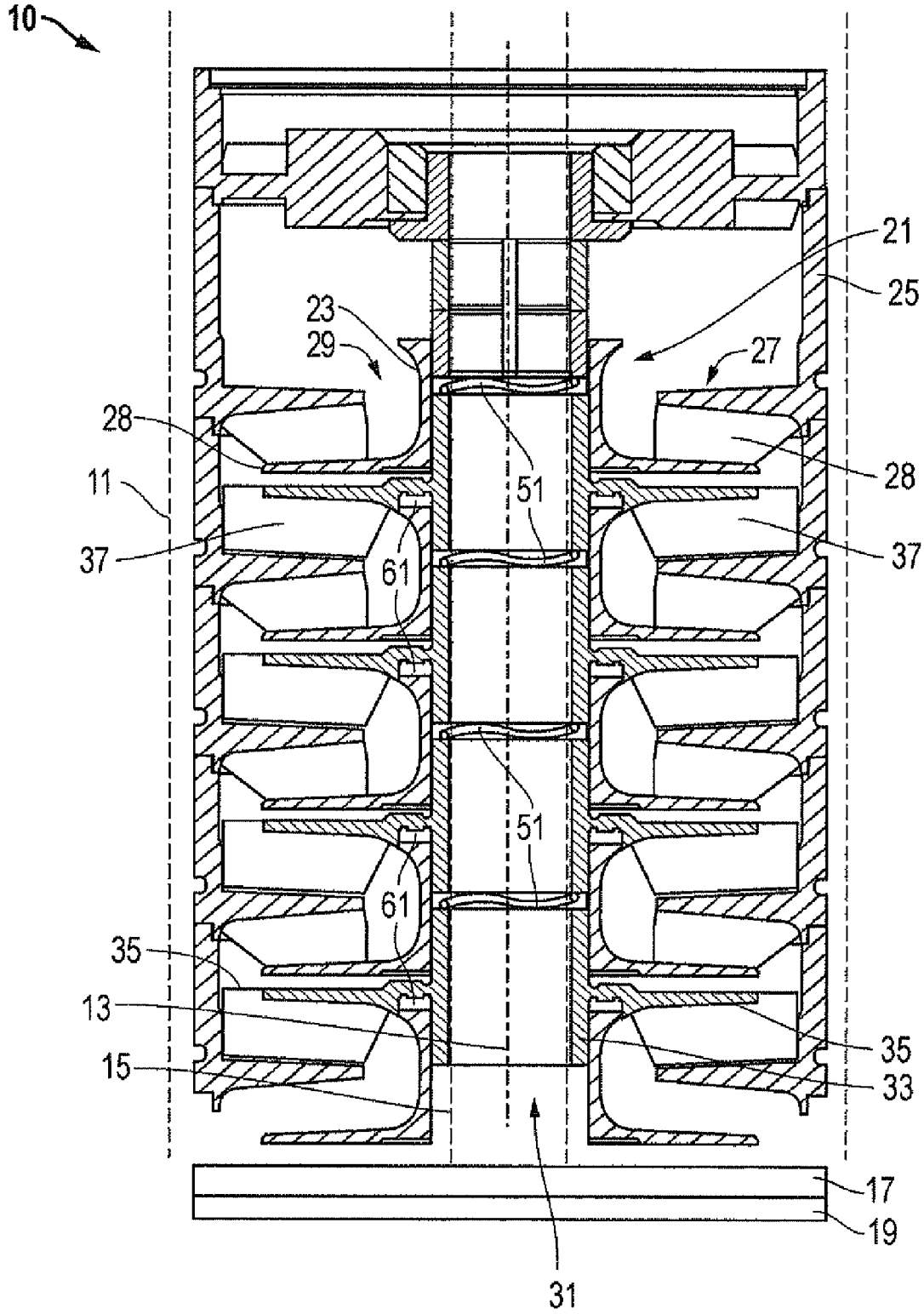
FIG. 1 is a sectional side view of one embodiment of a pump assembly constructed in accordance with the invention.

Referring to FIGS. 1-5, embodiments of a system, method and apparatus for open shrouded impeller and diffuser assemblies for multi-stage submersible pumps are disclosed. The invention is well suited for multi-stage, downhole electrical submersible pump (ESP) assemblies for pumping fluids such as oil and gas from wells. In some embodiments, the invention comprises a pump 10 having pump housing 11 (FIG. 1) having an axis 13 and a shaft 15. A seal section 17, motor 19 and optional gas separator (not shown) also may be mounted to the pump 10, depending on the application.

As shown in FIG. 1, a plurality of diffusers 21 are mounted to the pump housing 11 to define a diffuser stack. The diffusers 21 are fixed relative to the pump housing 11 and do not move. In some embodiments (FIG. 2), each diffuser 21 has a hub 23 with a central opening through which the shaft 15 extends, an outer wall 25, and a substantially radial surface 27 extending between the hub 23 and outer wall 25. Each diffuser 21 also has diffuser vanes 28 (FIG. 1) that define a fluid passage 29 (FIGS. 1 and 2) through which the pumped fluids flow.

Also shown in FIG. 1, a plurality of impellers 31 also are mounted in the pump housing 11. The impellers 31 are rigidly mounted to the shaft 15 between respective ones of the diffusers 21 to define an impeller stack. The impellers 31 rotate with the shaft 15 and thus move relative to the diffusers 21. In some embodiments (FIGS. 3 and 5), each of the impellers 31 has a hub 33 with a central opening through which the shaft 15 extends. Each hub 33 has a single "upper" shroud 35 that extends substantially radially from the hub 33. The impellers 31 do not have lower shrouds and are thus provided as "open" impellers. A plurality of vanes 37 extend substantially axially from the single shroud 35. In one embodiment, the impellers 31 may be formed from powdered metallurgy and comprise no fused components.

Figure 3:
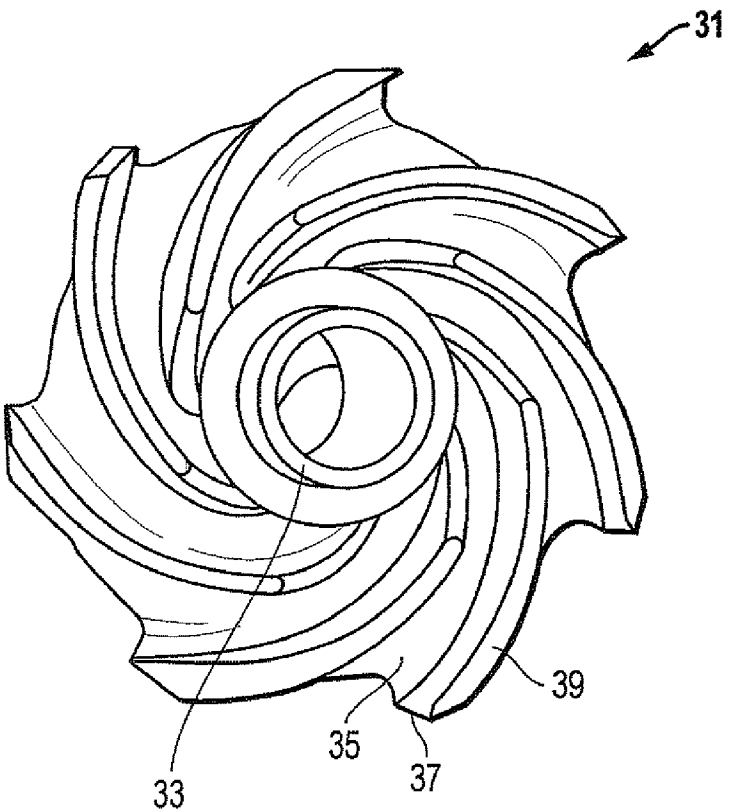
FIG. 3 is an isometric view of one embodiment of an impeller for the pump assembly of FIG. 1 and is constructed in accordance with the invention.
Figure 2:
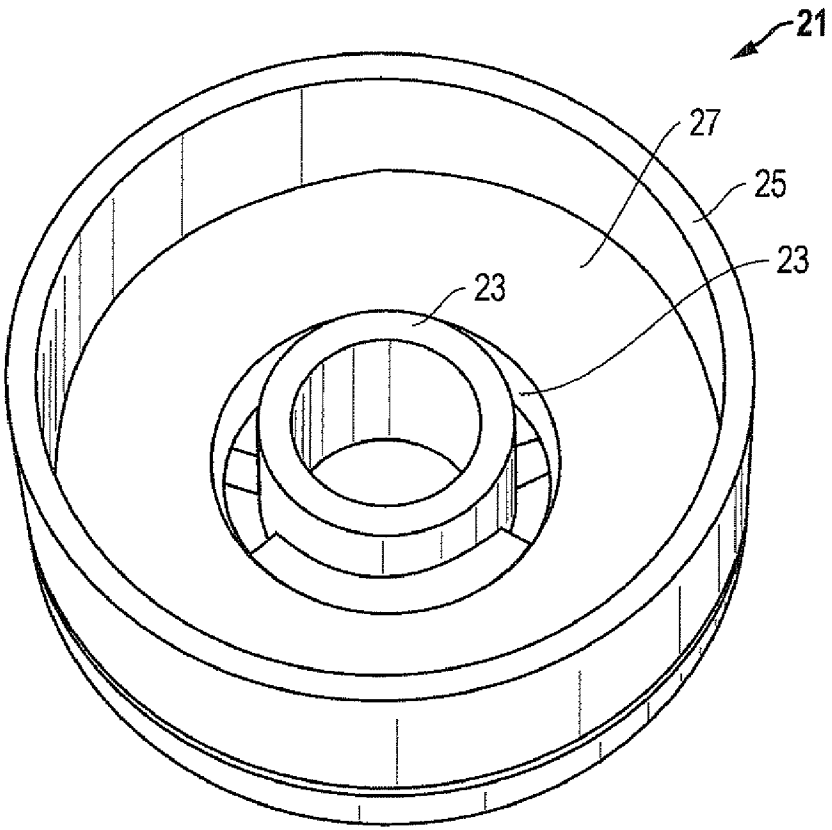
FIG. 2 is an isometric view of one embodiment of a diffuser for the pump assembly of FIG. 1 and is constructed in accordance with the invention.
Figure 5:
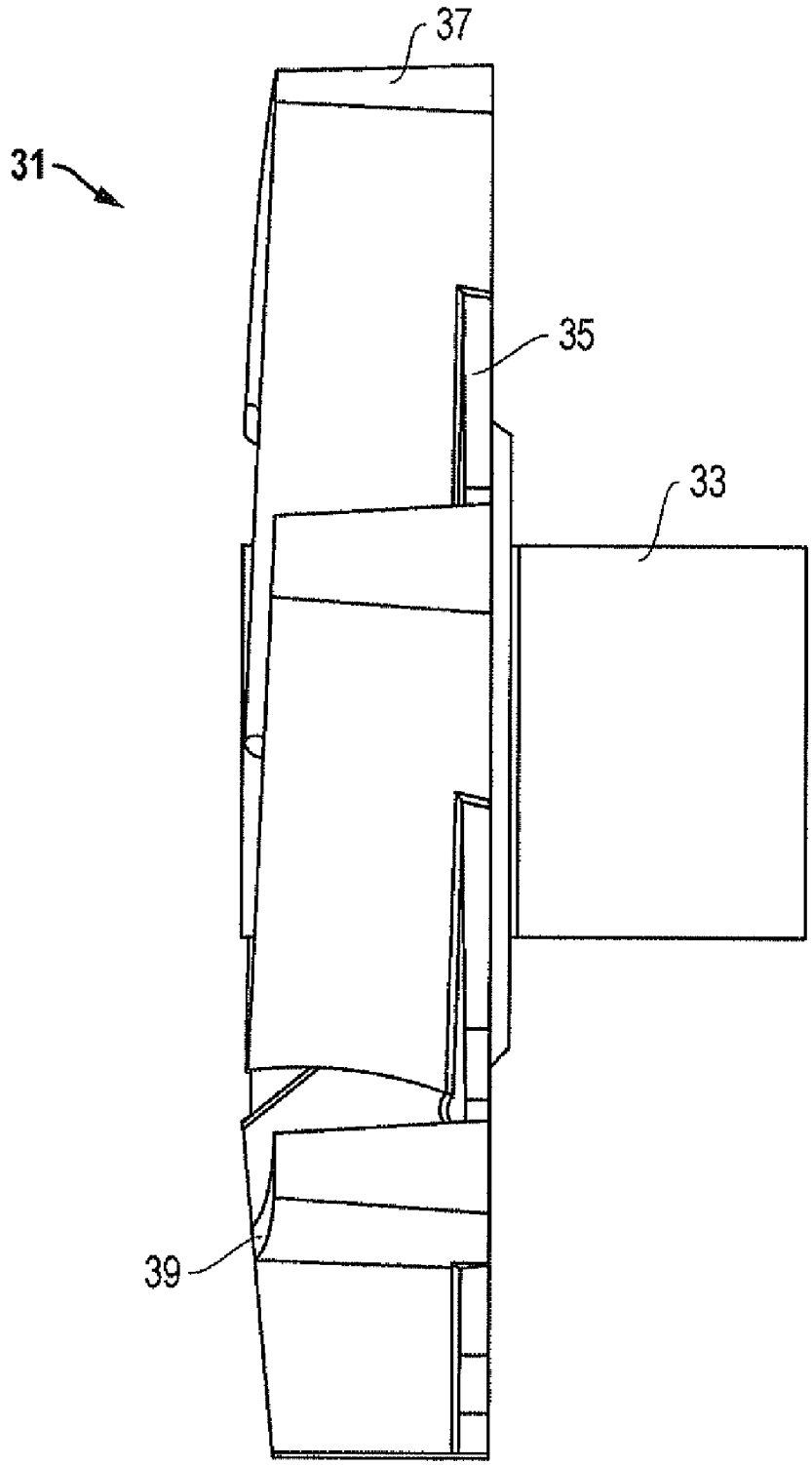
FIG. 5 is a side view of one embodiment of the impeller of FIG. 3 and is constructed in accordance with the invention.

As shown in FIGS. 3 and 5, each of the impeller vanes 37 has a "free" (i.e., unshrouded) radial surface 39 that directly faces a respective one of the diffuser radial surfaces 27 unimpeded. See, e.g., FIG. 1. In some embodiments, the impeller vane and diffuser radial surfaces 39, 27, respectively, are parallel to each other. The impeller vane radial surfaces 39 extend in an axially upstream direction (i.e., down the well), and the diffuser radial surfaces 27 extend in an axially downstream direction (i.e., up the well). Thus, surfaces 27, 39 are "mating" surfaces that match each other in one configuration. This design makes both the diffusers 21 and impellers 31 axially shorter than conventional designs as they have no conventional eye washer pads, or lower shrouds, respectively.

As illustrated in FIG. 1, embodiments of the invention further comprise biasing means 51 located between axial ends of the hubs 33 of adjacent ones of the impellers 31. The biasing means 51 directly biases the impellers 31 against each other. The biasing means 51 perform as adjustable spacers between the impellers 31 to provide axial forces that are greater than the hydraulic thrust exerted on the impellers during operation to prevent the impellers from floating axially between the diffusers 21. In contrast, conventional designs use closely-toleranced sleeves or shims of different sizes to accommodate the variations between the conventional impellers. Thus, the impellers 31 constructed in accordance with the invention do not move axially with respect to each other. The biasing means 51 act as adjustable spacers and provide a greater axial force than the hydraulic thrust imposed on the pump assembly.

Figure 4C:
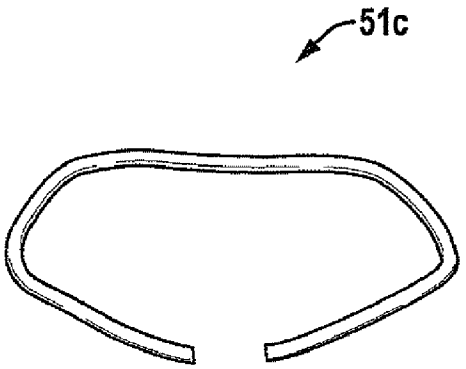
FIGS. 4A-4C are isometric views of various embodiments of biasing means for the pump assembly of FIG. 1 and are constructed in accordance with the invention.
Figure 4B:
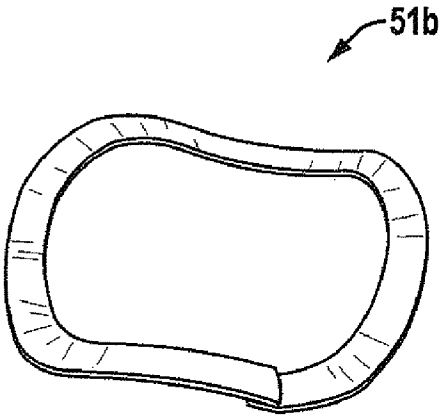
Figure 4A:
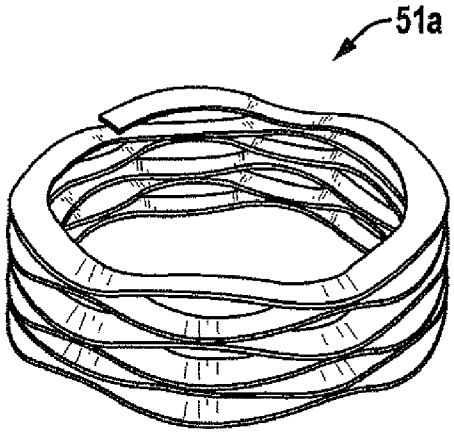

In some embodiments, the biasing means 51 comprises wave springs (see, e.g., wave springs 51*a-c* in FIGS. 4A-C). The wave springs 51 are located between the hubs 33 (FIG. 1) of adjacent ones of the impellers 31 to provide axial loads between the impellers. The wave springs 51 take up tolerance variations in the diffuser stack to keep the impellers 31 in a proper running position relative to the diffusers 21. The tolerance variations between the diffusers 21 provide the impellers 31 with an axial degree of freedom in a range limited to an axial length tolerance of the hubs 33 of the impellers 31. The biasing means also may comprise Belleville washers or disk springs.

In some embodiments, the invention further comprises thrust washers 61 (FIG. 1) that are located axially between respective ones of the impellers 31 and diffusers 21 to maintain the impellers in proper locations and reduce erosion of the impellers. The thrust washers 61 may be formed from a hard material such as tungsten carbide or ceramic.

The invention has numerous advantages. A multi-stage submersible pump according to the invention permits higher a stages-per-housing ratio, a shorter stack length, and a higher head pressure per housing performance rating than conventional designs. The invention also increases the ease of assembly and reduces cost by eliminating close-tolerance parts.

While the invention has been shown or described in only some of its forms, it should be apparent to those skilled in the art that it is not so limited, but is susceptible to various changes without departing from the scope of the invention.

What is claimed is:

1. A multi-stage submersible pump, comprising:

a pump housing having an axis and a shaft;

a plurality of diffusers mounted to the pump housing to define a diffuser stack;

a plurality of impellers mounted in the pump housing on the shaft between respective ones of the diffusers to define an impeller stack, each of the impellers having a hub with a single shroud extending radially from the hub, and a plurality of vanes extending axially from the single shroud; and biasing means located between axial ends of adjacent ones of the impellers for directly biasing the impellers against each other.

2. A multi-stage submersible pump according to claim 1, wherein the biasing means perform as adjustable spacers between the impellers to provide axial forces greater than hydraulic thrust exerted on the impellers to prevent the impellers from floating axially between the diffusers.

3. A multi-stage submersible pump according to claim 1, wherein the biasing means comprises wave springs located between the hubs of adjacent ones of the impellers.

4. A multi-stage submersible pump according to claim 1, wherein the biasing means comprises wave springs to provide an axial load between the impellers, and the wave springs take up tolerance variations in the diffuser stack to keep the impellers in a proper running position relative to the diffusers.

5. A multi-stage submersible pump according to claim 1, wherein the biasing means provides the impellers with an axial degree of freedom comprising a range limited to an axial length tolerance of the hubs of the impellers.

6. A multi-stage submersible pump according to claim 1, further comprising thrust washers between respective ones of the impellers and diffusers to maintain the impellers in proper locations and reduce erosion of the impellers.

7. A multi-stage submersible pump according to claim 6, wherein the thrust washers are formed from a hard material selected from the group consisting of tungsten carbide and ceramic.

8. A multi-stage submersible pump according to claim 1, wherein each of the diffusers has a radial surface, and each of the impeller vanes has a radial surface that directly faces a respective one of the diffuser radial surfaces unimpeded.

9. A multi-stage submersible pump according to claim 8, wherein the impeller and diffuser radial surfaces are parallel to each other, the impeller radial surfaces extending in an axially upstream direction, and the diffuser radial surfaces extending in an axially downstream direction.

10. A multi-stage submersible pump according to claim 1, wherein the impellers are formed from powdered metallurgy and comprise no fused components.

11. A multi-stage downhole electrical submersible pump (ESP) for a well, comprising:

a pump housing having an axis and a shaft;

a plurality of diffusers mounted to the pump housing to define a diffuser stack;

a plurality of impellers mounted in the pump housing on the shaft between respective ones of the diffusers to define an impeller stack, each of the impellers having a hub with a single shroud extending radially from the hub, and a plurality of vanes extending axially from the single shroud; and biasing means located between axial ends of adjacent ones of the impellers for directly biasing the impellers against each other, the biasing means performing as adjustable spacers between the impellers to provide axial forces greater than hydraulic thrust exerted on the impellers to prevent the impellers from floating axially between the diffusers.

12. A multi-stage downhole ESP according to claim 11, wherein the biasing means comprises wave springs located between the hubs of adjacent ones of the impellers to provide an axial load between the impellers.

13. A multi-stage downhole ESP according to claim 12, wherein the wave springs take up tolerance variations in the diffuser stack to keep the impellers in a proper running position relative to the diffusers.

14. A multi-stage downhole ESP according to claim 13, wherein the tolerance variations provide the impellers with an axial degree of freedom in a range limited to an axial length tolerance of the hubs of the impellers.

15. A multi-stage downhole ESP according to claim 11, further comprising thrust washers between respective ones of the impellers and diffusers to maintain the impellers in proper locations and reduce erosion of the impellers.

16. A multi-stage downhole ESP according to claim 15, wherein the thrust washers are formed from a hard material selected from the group consisting of tungsten carbide and ceramic.

17. A multi-stage downhole ESP according to claim 11, wherein each of the diffusers has a radial surface, and each of the impeller vanes has a radial surface that directly faces a respective one of the diffuser radial surfaces unimpeded.

18. A multi-stage downhole ESP according to claim 17, wherein the impeller and diffuser radial surfaces are parallel to each other, the impeller radial surfaces extend in an axially upstream direction, and the diffuser radial surfaces extend in an axially downstream direction.

* * * * *